United States Patent [19]

Seidel

[11] 4,256,000

[45] Mar. 17, 1981

[54] ADJUSTABLE WORKSTOP

[76] Inventor: Charles Seidel, 436 Girard, Royal Oak, Mich. 48073

[21] Appl. No.: 44,920

[22] Filed: Jun. 4, 1979

[51] Int. Cl.[3] ..... B27B 27/10

[52] U.S. Cl. ..... 83/468; 83/467 R; 83/471.2; 83/522

[58] Field of Search ..... 83/467, 468, 471.2, 83/522

[56] References Cited

U.S. PATENT DOCUMENTS

| | | | |
|---|---|---|---|
| 2,518,728 | 8/1950 | Snow | 83/467 |
| 2,618,300 | 11/1952 | Freudenthaler | 83/468 |
| 2,838,078 | 6/1958 | Cusanza | 83/468 |
| 3,095,673 | 7/1963 | Born et al. | 83/468 X |
| 3,348,591 | 10/1967 | Carrasco | 83/467 |

*Primary Examiner*—Donald R. Schran
*Attorney, Agent, or Firm*—Giffford, VanOphem, Sheridan & Sprinkle

[57] ABSTRACT

An adjustable workstop is provided for use in conjunction with a radial saw means having a table upon which the work to be machined is supported, an elongated fence secured to the table and protruding upwardly therefrom thus forming a substantially verticle surface against which at least a portion of the work is positioned, and a radial saw which is movable across the table in a direction transverse to the fence. The workstop device comprises a body having a rectangular channel formed therethrough which can be positioned over the fence protruding upwardly from the table and, upon doing so, a portion of the body forms a workstop surface extending generally perpendicularly outwardly from the fence. A clamp extends into the channel for adjustably securing the workstop device to the fence. In the preferred form of the invention, the body comprises a first part which is secured to the fence and a second part which is movable relative to the first part in a direction parallel to the longitudinal axis of the fence and the workstop surface is formed on the movable body part.

4 Claims, 5 Drawing Figures

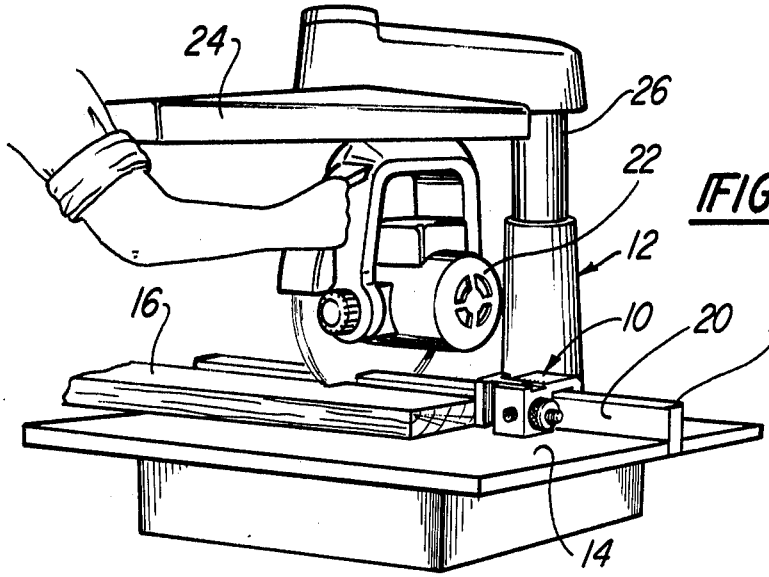
FIG-1
FIG-3
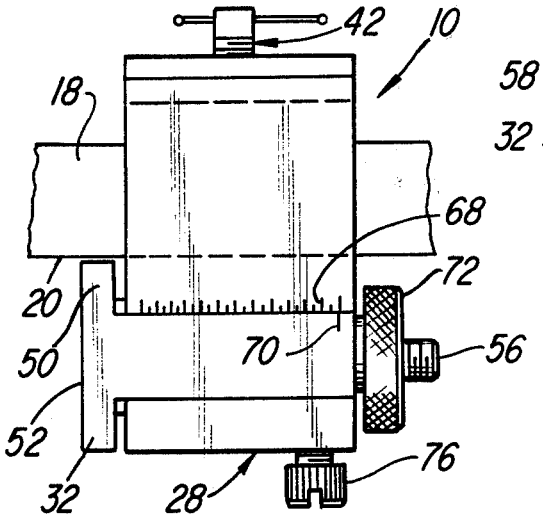
FIG-2
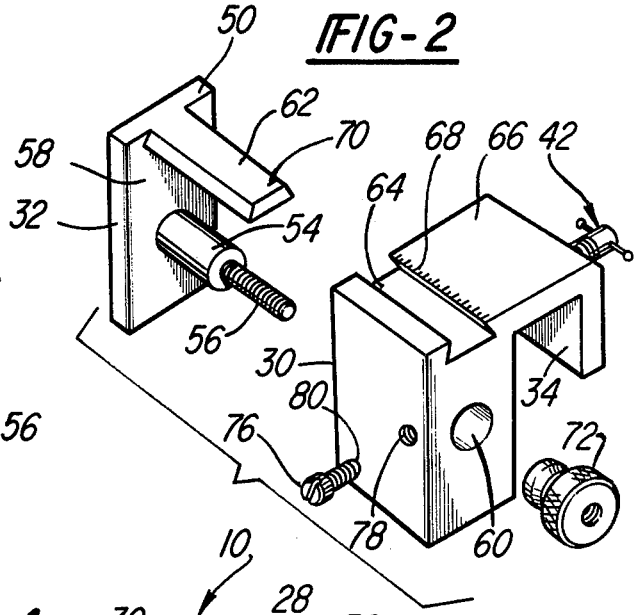
FIG-4
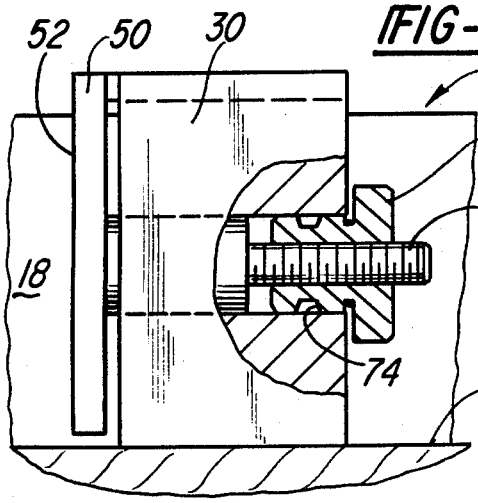
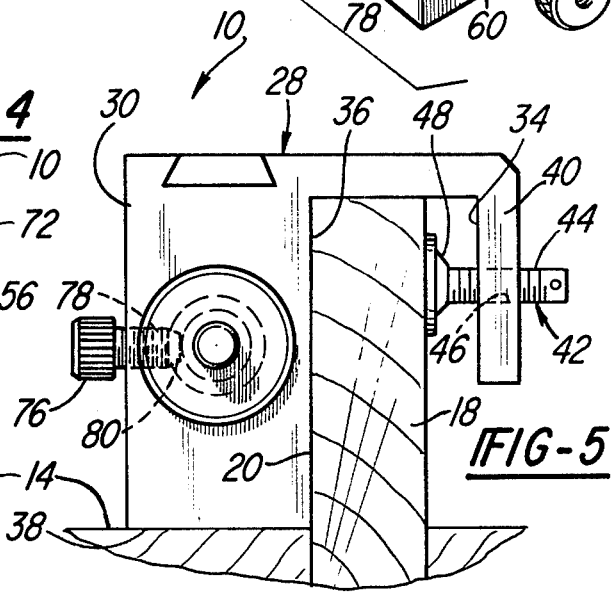
FIG-5

ADJUSTABLE WORKSTOP

BACKGROUND OF THE INVENTION

I. Field of the Invention

The present invention relates generally to work positioning devices and, more particularly, to such a device for use with a radial saw.

II. Description of the Prior Art

Radial saws, due to their versatility and relatively low cost, have enjoyed widespread acceptance and use. Such radial saws generally comprise a planar worktable upon which the work to be machined is positioned. In addition, an elongated narrow fence is secured to the table and protrudes upwardly therefrom thus forming a vertical support surface against which the work or workpiece is positioned. A saw means is then secured by a column to the table and is movable across the table in a direction transverse to the fence.

The work itself is usually slidable along the fence in order to vary the length of the piece which is to be cut from to work. Thus, when using the saw, it is necessary to measure from the end of the work and to the saw blade in order to machine the work to the desired length.

When it is desired to cut a number of pieces from the workpiece all having the same lineal length, however, the process of repeatedly measuring the work prior to each cut is not only tedious and time-consuming, but also inaccurate. Consequently, when a number of pieces of the same length are to be cut from the work, it has been the previous practice to clamp a block of wood to the worktable so that one edge of the wood block is at the desired distance from the saw blade.

This solution, however, has not proven entirely satisfactory in use. Oftentimes a block of wood of the proper size is unavailable and/or must be separately prepared. Moreover, it is difficult and time-consuming to accurately clamp the wood block to the table at the desired distance from the saw blade.

SUMMARY OF THE PRESENT INVENTION

The present invention overcomes these problems by providing a workstop member which can be easily and simply secured to the fence of the worktable and which can be accurately and variably adjusted.

In brief, the workstop member according to the present invention comprises a body having a rectangular channel formed therethrough of a dimension sufficient to fit over the upwardly protruding portion of the fence on the worktable. With the workstop member positioned over the fence in this fashion, one end of the body forms a work abutment surface extending generally perpendicularly outwardly from the vertical support surface of the fence. A clamp threadably engages the body and has a portion extending into the rectangular channel so that the body can be adjustably secured at any desired position along the fence.

In the preferred form of the invention, the body further comprises a first part which is rigidly, but adjustably, secured to the fence, and a movable part whih also forms the workstop surface. The movable part is adjustably movable in a direction generally parallel to the longitudinal axis of the fence.

In use, the body is secured to the fence by the clamp at approximately the desired distance away from the saw blade. Thereafter, the movable body part is adjusted and provides the fine adjustment for the desired distance between the workstop surface and the saw blade.

BRIEF DESCRIPTION OF THE DRAWING

A better understanding of the present invention will be had upon reference to the following detailed description when read in conjunction with the accompanying drawings, wherein like reference characters refer to like parts throughout the several views, and in which:

FIG. 1 is a perspective view illustrating the device according to the present invention on a radial saw table;

FIG. 2 is an exploded perspective view illustrating the device according to the present invention;

FIG. 3 is a top plan view illustrating the device according to the present invention;

FIG 4 is a partial fragmentary front plan view of the device according to the present invention; and FIG. 5 is a rear end view illustrating the device according to the present invention.

DETAILED DESCRIPTION OF THE PRESENT INVENTION

With reference first to FIG. 1, the workstop device 10 according to the present invention, is thereshown secured to a radial saw means 12. The radial saw means 12 generally comprises a planar table 14 upon which a work 16 is positioned. An elongated fence 18 is secured to and protrudes upwardly from the table 14 thus forming a vertical work abutment surface 20. A rotating saw means 22 is in turn secured to the table 14 by a column 26 and is movable along a rack 24 in a direction transverse to the longitudinal axis of the fence 18.

With reference now to FIGS. 2 and 3, the workstop device 10 according to the present invention is thereshown in greater detail and comprises a body 28 having a first part and a second part 32. A rectangular channel 34 is formed through the first part 30 of the body 28 and has a width greater than the width of the fence 18 so that the fence 18 can be received within the channel 34 as is best shown in FIG. 5. With the channel 34 positioned over the fence 18, one side 36 of the channel 34 flatly abuts against the work abutment surface 20 on the fence 18 while the bottom 38 of the housing 28 flatly abuts against the surface of the table 14.

Referring now particularly to FIG. 5, the body 28 includes a downwardly depending flange 40 which extends downwardly along the rear side 21 of the fence 18. A clamp 42 having a threaded shank 44 is threadably mounted in a threaded bore 46 through the flange 40. A clamping element 48 is secured to one end of the shank 44 so that the clamping element 48 is positioned within the channel 34. The clamping element 48 abuts against the rear side 21 of the fence 18. Thus, by selectively tightening and loosening the clamp 42, the body 28 can be longitudinally, adjustably secured to the fence 18 at any desired position along the fence 18.

With reference now to FIGS. 2-4, the second body part 32 further comprises a plate 50 having a vetical surface 52 which extends perpendicularly outwardly from the work abutment surface 20 of the fence 18. A pin 54 having a threaded coaxial shank 56 extends perpendicularly outwardly from the other side 58 of the plate 50 is slidably received within a bore 60 formed through the first body part 30. A guide member 62 is also secured to the plate 50 and extends perpendicularly outwardly from the rear side 58 of the plate 50 and in a direction generally parallel to the pin 54. The guide 62 is received within a like-shaped channel 64 formed along the top 66 of the first body part 30. If desired, indicia 68 on the first body part 30 and indicia 70 on the guide 62 provides an indication of the relative position between the body parts 30 and 32.

With reference now to FIGS. 4 and 5, a thumb nut 72 having a circumferential recess 74 is pivotally positioned within the bore 60 and threadably engages the threaded shank 56 secured to the second body member 32. A thumbscrew 76 is threadably engaged with a bore 78 in the first body part 30 and the bore 78 perpendicularly intersects the bore 60. The thumbscrew 76 further includes a rounded nose 80 which is positioned within the circumferential recess 74 on the thumb nut 72. The thumbscrew 76 thus prevents axial displacement of the thumb nut 72 along the bore 60 and, when tightened, prevents rotation of the thumb nut 72.

With reference now particularly to FIGS. 1 and 3, in operation, the device 10 is positioned on the saw table 14 so that the fence 18 is received within the channel 34 and the device 10 is adjusted longitudinally along the fence 18 to approximately the desired position from the saw blade. When properly adjusted, the first body part 30 is securely, but detachably, clamped to the fence 18 by the clamp 42. Thereafter, after, the thumbscrew 76 is loosened which permits the thumb nut 72 to rotate.

The thumbscrew 72 is then rotated until the workstop surface 52 is positioned way from the saw blade at precisely the desired position and the thumbscrew 72 is then tightened thus locking the body parts 32 and 30 against movement relative to each other. The work is then abutted against the surface 52 and the cutting or machining operation can be then repeatedly carried out in the conventional fashion.

It can therefore be seen that the device 10 according to the present invention provides a simple, inexpensive, and yet totally effective adjustable workstop for a radial saw table.

Having described my invention, however, many modifications thereto will become apparent to those skilled in the art to which it pertains without deviation from the spirit of the invention as defined by the scope of the appended claims.

I claim:

1. For use in conjunction with a radial saw means having a table upon which work to be machined is supported, an elongated fence secured to the table, said fence protruding upwardly from said table and forming a substantially vertical surface against which at least a portion of the work is positioned, and machining means movable across said table in a direction transverse to said fence, a work positioning device comprising:

a body, means for longitudinally infinitely adjustably securing said body to said fence, said body further comprising a first part and a second part, said first body part being rigidly attached to the fence by said securing means, said second body part having a workstop surface substantially perpendicular to said vertical surface and against which the work is positioned; and means for adjustably securing said body parts together in a direction substantially parallel to said fence, wherein said means for adjustably securing said body parts together further comprises, an elongated pin secured at one end to said second body part, said pin extending in a direction substantially parallel to the axis of the fence, said pin being slidably positioned within a bore in the first body part, a threaded member fixedly secured to and extending axially outwardly from said pin, a nut for threadably engaging said threaded member, said nut being accessible exteriorly of said body, and means for securing said nut against axial displacement with respect to the first body part so that rotation of said nut displaces said second body part with respect to said first body part in a direction substantially parallel to said fence.

2. The invention as defined in claim 1 wherein said body first part includes a channel dimensioned to fit over said fence and wherein said adjustable securing means comprises a clamp means having a clamp element positioned with said channel.

3. The invention as defined in claim 1 wherein said last-mentioned means comprises a screw member threadably secured to said body, siad screw member having on end accessible exteriorly of said body and its other end receivable in a circumferential groove in said nut whereby, upon tightening, said screw member prevents rotation of said nut.

4. The invention as defined in claim 3 and further comprising an elongated guide secured to said second body part and extending substantially parallel to the axis of the fence, said guide being slidably received in a recess on said first body part.

* * * * *

UNITED STATES PATENT AND TRADEMARK OFFICE

CERTIFICATE OF CORRECTION

PATENT NO. : 4,256,000

DATED : March 17, 1981

INVENTOR(S) : Charles Seidel

It is certified that error appears in the above–identified patent and that said Letters Patent are hereby corrected as shown below:

Column 1, line 61, delete "whih" and insert --which-- therefor;

Column 2, line 37, after "part" first occurrence, insert --30--;

Column 3, line 25, delete "after,";

Column 3, line 28, delete "way" and insert --away-- therefor;

Column 4, line 40, delete "on" and insert --one-- therefor.

Signed and Sealed this

*Sixteenth* Day of *June 1981*

[SEAL]

*Attest:*

RENE D. TEGTMEYER

*Attesting Officer*

*Acting Commissioner of Patents and Trademarks*